US010714876B2

(12) United States Patent
Zhao

(10) Patent No.: US 10,714,876 B2
(45) Date of Patent: Jul. 14, 2020

(54) ELECTRICAL CONNECTOR HAVING A MIDDLE SHIELDING PLATE WITH ENGAGING ARMS FOR LOCKING TO A TERMINAL MODULE UNIT

(71) Applicant: FOXCONN INTERCONNECT TECHNOLOGY LIMITED, Grand Cayman (KY)

(72) Inventor: Jun Zhao, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/872,291

(22) Filed: Jan. 16, 2018

(65) Prior Publication Data

US 2018/0205183 A1 Jul. 19, 2018

(30) Foreign Application Priority Data

Jan. 16, 2017 (CN) ..... 2017 2 0048178 U

(51) Int. Cl.

*H01R 13/6585* (2011.01)
*H01R 13/6586* (2011.01)
*H01R 24/60* (2011.01)
*H01R 107/00* (2006.01)

(52) U.S. Cl.

CPC ..... *H01R 13/6585* (2013.01); *H01R 24/60* (2013.01); *H01R 2107/00* (2013.01)

(58) Field of Classification Search

CPC ..... H01R 13/6585; H01R 13/6273; H01R 13/6581; H01R 13/658; H01R 13/6594; H01R 12/724; H01R 2107/00; H01R 24/60

USPC ..... 439/607.09, 607.58, 607.57, 607.55, 439/607.51, 607.36, 607.27, 607.28, 439/607.23, 607.06, 607.08, 607.05

See application file for complete search history.

(56) References Cited

U.S. PATENT DOCUMENTS 7,670,156 B2 * 3/2010 Chen ..... H01R 13/6485 439/108
9,022,800 B2 * 5/2015 Yang ..... H01R 13/6581 439/487
9,214,766 B1 * 12/2015 Yu ..... H01R 13/6585
9,276,365 B2 * 3/2016 Yu ..... H01R 13/6594
9,306,345 B2 * 4/2016 Hsu ..... H01R 13/6582
9,461,415 B2 * 10/2016 Guo ..... H01R 13/41

(Continued)

FOREIGN PATENT DOCUMENTS

CN 204179385 U 2/2015
CN 105655786 A 6/2016

*Primary Examiner* — Edwin A. Leon
*Assistant Examiner* — Milagros Jeancharles
(74) *Attorney, Agent, or Firm* — Wei Te Chung; Ming Chieh Chang

(57) ABSTRACT

An electrical connector includes: a terminal module including a first unit having a first row of contacts, a second unit having a second row of contacts, and a shielding plate between the first and second units, each of the first and second units including a rear base and a front tongue, the rear base of the first unit being locked to the rear base of the second unit; and a shielding shell enclosing the terminal module, wherein the shielding plate has a pair of engaging arms, and the first unit has at a junction between the base and the tongue thereof two side portions locked to the pair of engaging arms.

3 Claims, 15 Drawing Sheets

(56) References Cited

U.S. PATENT DOCUMENTS

| | | | | |
|---|---|---|---|---|
| 9,525,244 | B1 * | 12/2016 | Hsu | H01R 13/6585 |
| 9,929,513 | B2 * | 3/2018 | Wang | H01R 13/6591 |
| 10,020,619 | B2 * | 7/2018 | Zhang | H01R 24/60 |
| 10,096,947 | B2 * | 10/2018 | Cheng | H01R 13/6581 |
| 10,211,574 | B2 * | 2/2019 | Zhao | H01R 13/506 |
| 10,297,952 | B2 * | 5/2019 | Zhao | H01R 13/504 |
| 2015/0194770 | A1 * | 7/2015 | Little | H01R 13/6582 439/607.27 |
| 2015/0270646 | A1 * | 9/2015 | Kao | H01R 13/6581 439/76.1 |
| 2015/0311636 | A1 | 10/2015 | Chang et al. | |
| 2015/0311645 | A1 * | 10/2015 | Chang | H01R 13/6594 439/607.28 |
| 2015/0364888 | A1 * | 12/2015 | Yu | H01R 13/6585 264/250 |
| 2015/0380868 | A1 | 12/2015 | Chen et al. | |
| 2016/0043511 | A1 * | 2/2016 | Hsu | H01R 13/6585 439/607.05 |
| 2016/0141805 | A1 | 5/2016 | Zhao et al. | |
| 2016/0197443 | A1 | 7/2016 | Zhang | |
| 2016/0233630 | A1 | 8/2016 | Cheng et al. | |
| 2017/0194750 | A1 | 7/2017 | Zhao et al. | |
| 2017/0194754 | A1 * | 7/2017 | Tsai | H01R 13/502 |
| 2017/0288326 | A1 * | 10/2017 | Wang | H01R 12/775 |
| 2018/0175559 | A1 * | 6/2018 | Zhao | H01R 13/6591 |

* cited by examiner

ELECTRICAL CONNECTOR HAVING A MIDDLE SHIELDING PLATE WITH ENGAGING ARMS FOR LOCKING TO A TERMINAL MODULE UNIT

BACKGROUND OF THE INVENTION

1. Field of the Invention

The present invention relates to an electrical connector including a first terminal module unit, a second terminal module unit, and a shielding plate between the first and second units, wherein the first and second units are locked to each other at a rear thereof as well as at another location to obtain a properly secured subassembly ready for subsequent processing.

2. Description of Related Art

U.S. patent application Publication No. 2016/0141805 discloses an electrical connector comprising a terminal module including a first unit having a first row of contacts, a second unit having a second row of contacts, and a shielding plate between the first and second units. Each of the first and second units including a rear base and a front tongue. The rear base of the first unit is locked to the rear base of the second unit; the front tongue of the first unit is locked to the front tongue of the second unit.

China Patent Application Publication No. 105655786 discloses an electrical connector comprising a terminal module including a first unit having a first row of contacts, a second unit having a second row of contacts, and a shielding plate between the first and second units. Each of the first and second units including a rear base and a front tongue. The rear base of the first unit is locked to the rear base of the second unit, the front tongue of the second unit engages a front of the shielding plate, and the front tongue of the first unit is locked to the front tongue of the second unit.

SUMMARY OF THE INVENTION

An electrical connector comprises: a terminal module including a first unit having a first row of contacts, a second unit having a second row of contacts, and a shielding plate between the first and second units, each of the first and second units including a rear base and a front tongue, the rear base of the first unit being locked to the rear base of the second unit; and a shielding shell enclosing the terminal module, wherein the shielding plate has a pair of engaging arms, and the first unit has at a junction between the base and the tongue thereof two side portions locked to the pair of engaging arms.

DETAILED DESCRIPTION OF THE PREFERRED EMBODIMENT

Figure 1:
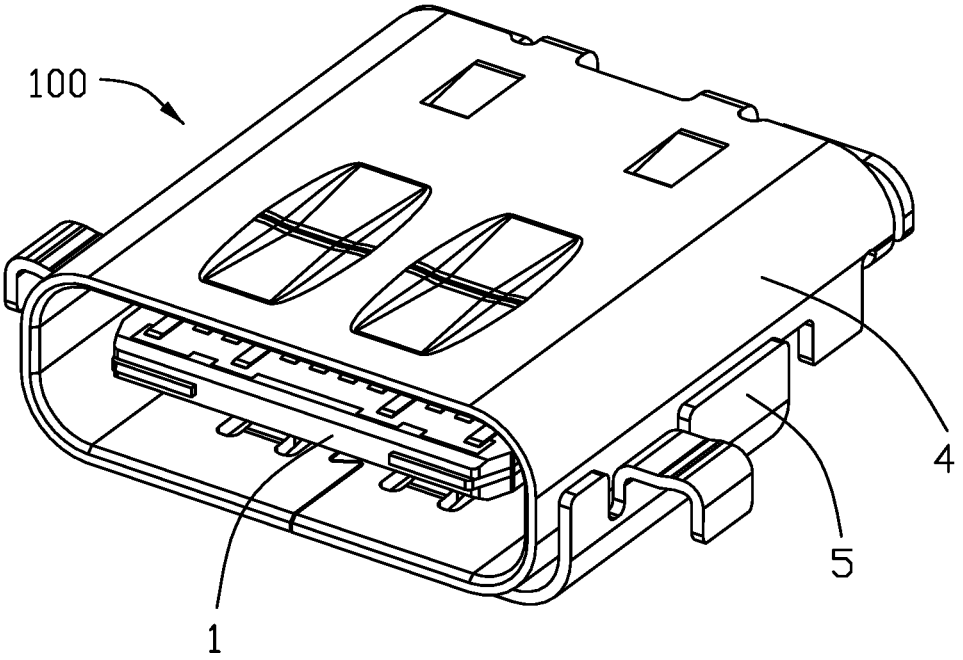
FIG. 1 is a perspective view of an electrical connector in accordance with a first embodiment of the present invention.
Figure 2:
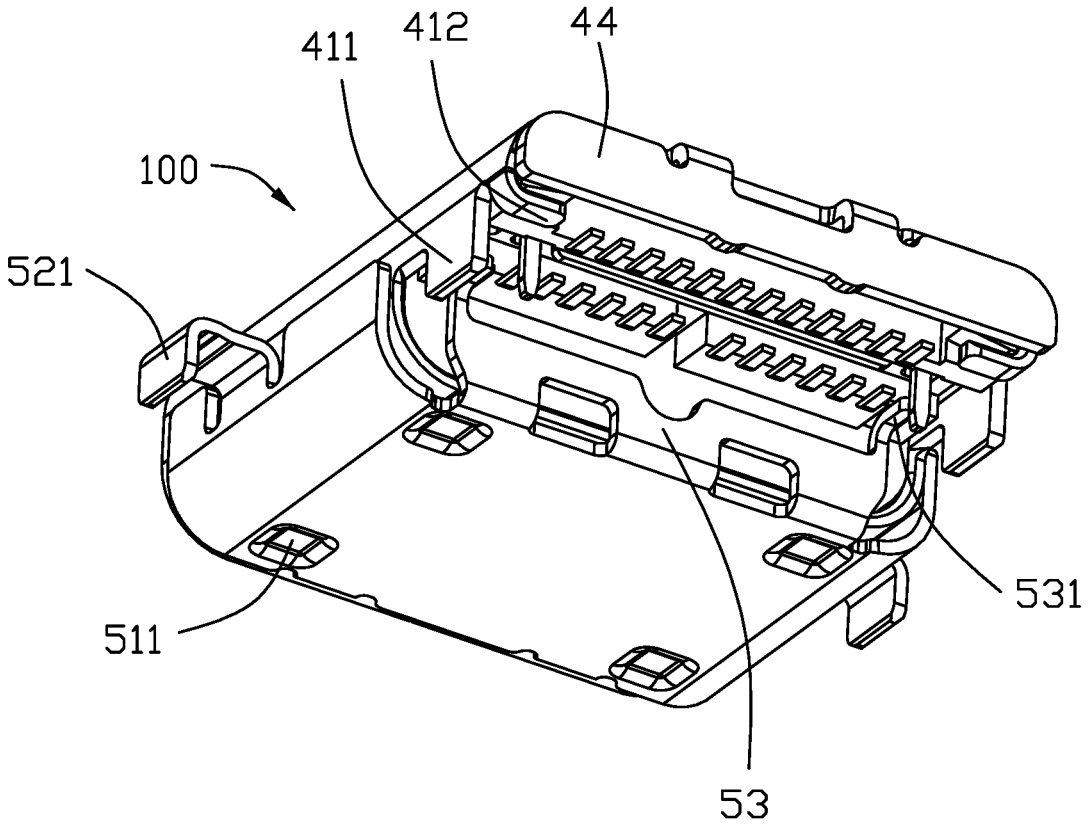
FIG. 2 is another perspective view of the electrical connector.
Figure 3:
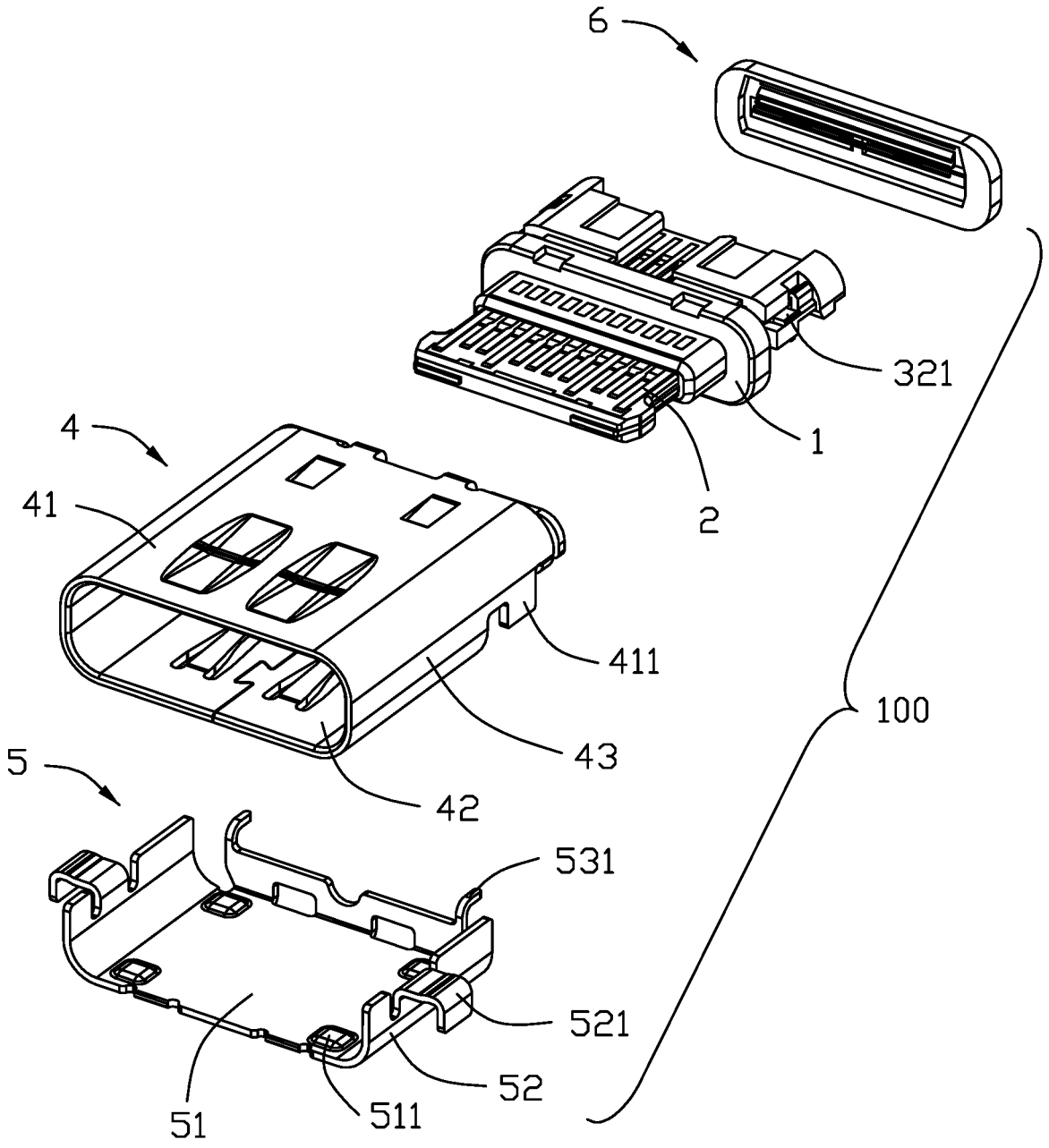
FIG. 3 is an exploded view of the electrical connector.
Figure 4:
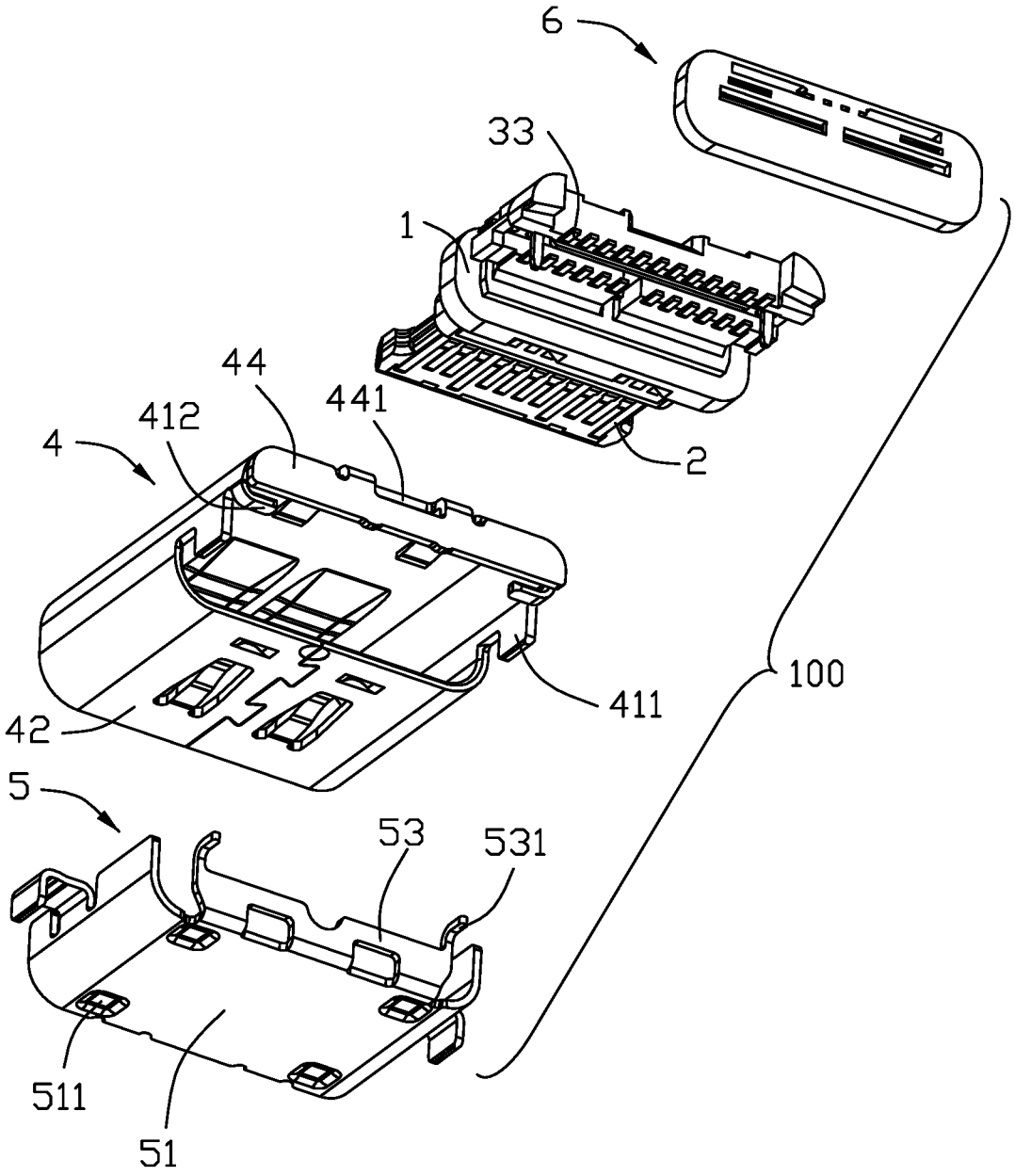
FIG. 4 is another exploded view of the electrical connector.

Referring to FIGS. 1-8, an electrical connector 100 includes an insulative housing 1, a plurality of contacts 2 and a middle shielding plate 3 secured to the insulative housing 1, and a shielding shell 4 enclosing the insulative housing 1. The insulative housing 1, the contacts 2, and the shielding plate 3 constitute a terminal module. The electrical connector 100 may further include an auxiliary shell 5 mounted to the shell 4 and a sealing member 6.

Referring to FIGS. 3-8, the insulative housing 1 includes an upper insulator 11, a lower insulator 12, and an over-molding insulator 13. The upper insulator 11 includes a base 111 and a tongue 112. The base 111 has a hole 113, two recesses 114, and two outer notches 115. The tongue 112 has a recess 116. The lower insulator 12 includes a base 121 and a tongue 122. The base 121 has a hole 123 and two latches 124 for locking to the notches 115. The tongue 122 has two protrusions 125 and a recess 126. The insulator 13 has two side notches 131. The bases 111 and 121 and a part of the insulator 13 constitute an overall base of the insulative housing 1; the tongues 112 and 122 and another part of the insulator 13 constitute an overall tongue of the insulative housing 1.

The plurality of contacts 2 include an upper row of contacts 21 secured to the upper insulator 11 to form an upper unit and a lower row of contacts 22 secured to the lower insulator 12 to form a lower unit.

Referring again to FIGS. 1-8, the upper contact 21 includes a contacting portion 211 and a soldering portion 212 and the lower contact 22 includes a contacting portion 221 and a soldering portion 222. The upper contacting portions 211 and the lower contacting portions 221 are reversely-symmetrically arranged, as is well known in this art.

Figure 5:
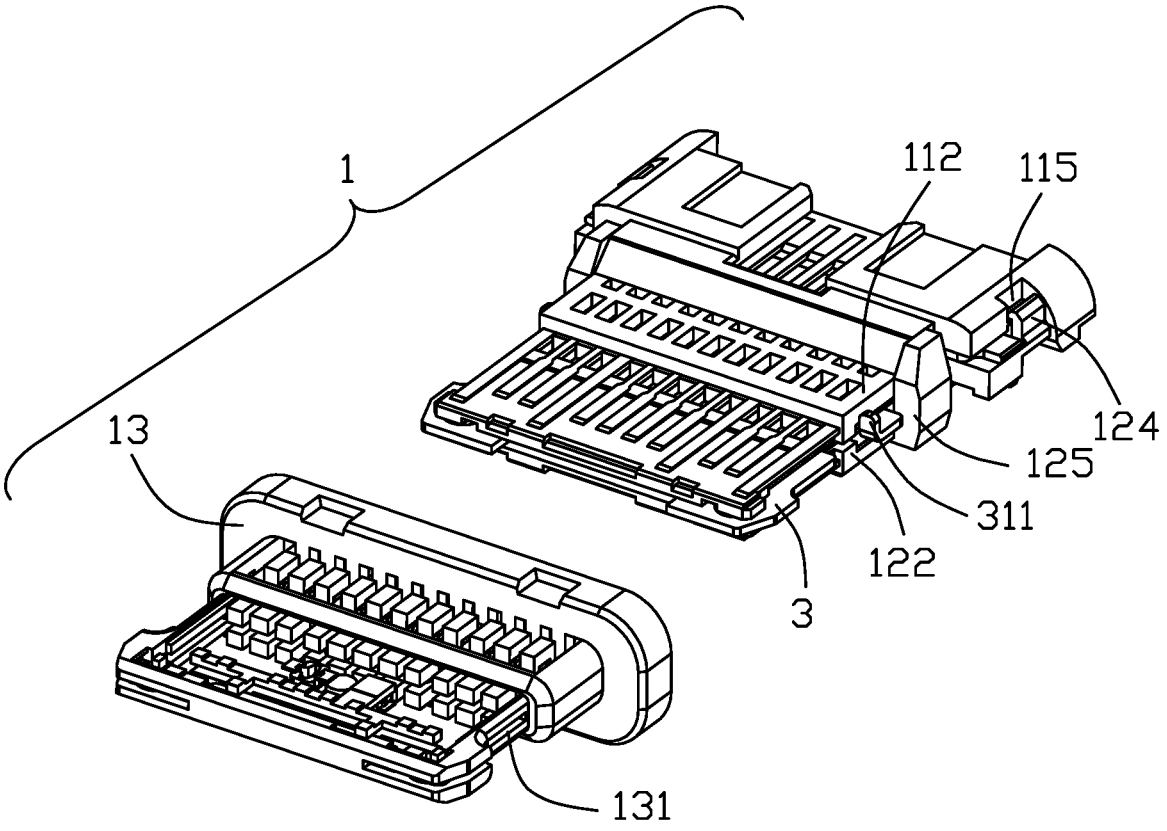
FIG. 5 is an exploded view of a terminal module of the electrical connector.
Figure 6:
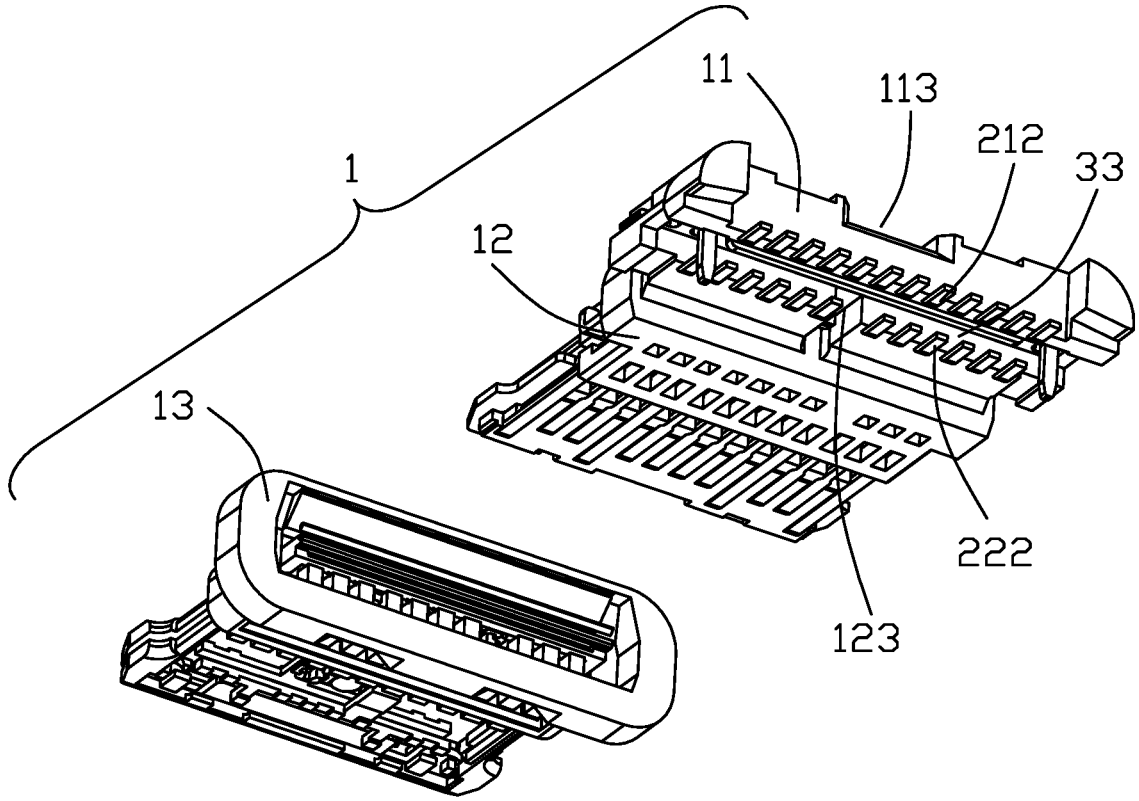
FIG. 6 is another exploded view of the terminal module.
Figure 7:
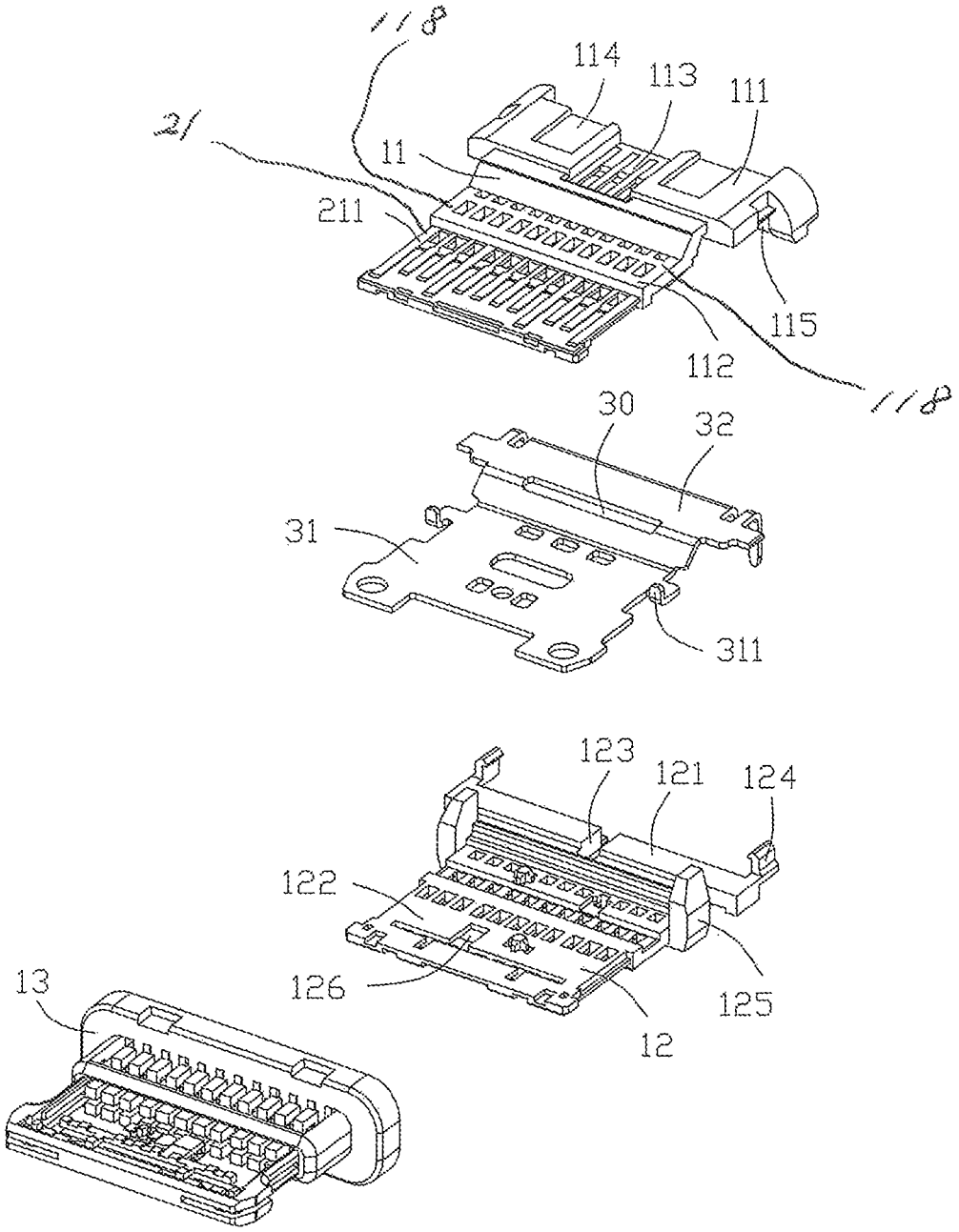
FIG. 7 is a further exploded view of the terminal module in FIG. 5.
Figure 8:
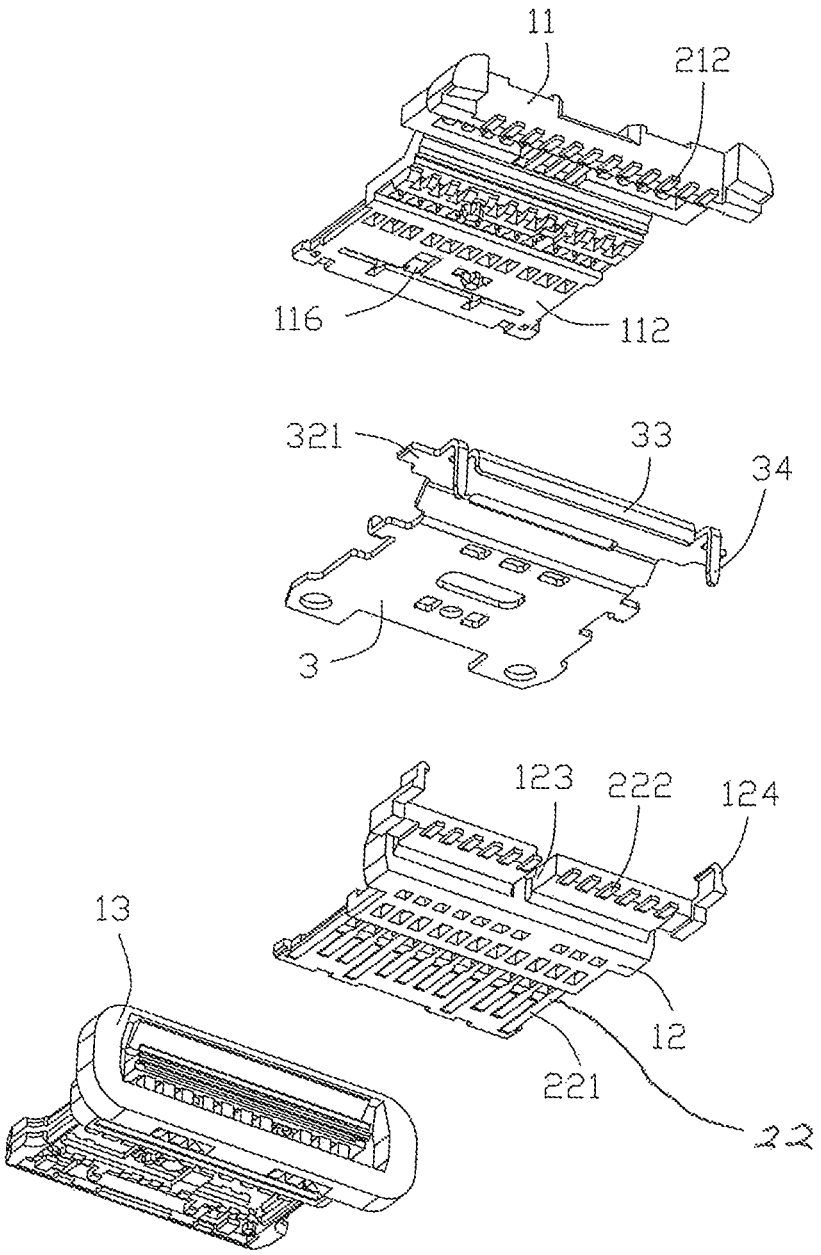
FIG. 8 is view similar to FIG. 7 but from a different perspective.

The shielding plate 3 is clamped between the upper insulator 11 and the lower insulator 12. The shielding plate 3 has a main portion 31, a rear extension 32, a rear portion 33, and a pair of legs 34. The shielding plate has a pair of flexible engaging arms 311. As shown in FIG. 5, the upper insulator 11 has at a junction between the base 111 and the tongue 112 two side portions 118 and the pair of engaging arms 311 flexibly grip two opposite outer faces of the two side portions 118. After over-molding the insulator 13, the pair of engaging arms 311 are buried. A hole 30 is formed at a junction between the main portion 31 and the extension 32. The rear extension 32 has a pair of tabs 321 for contacting the shielding shell 4.

Referring to FIGS. 1-8, the shielding shell 4 has a top wall 41, a bottom wall 42, and a pair of side walls 43. The top wall 41 has a pair of positioning legs 411 and a pair of fixing legs 412. A rear plate 44 is bent down from the top wall 4. The rear plate 44 has a hole 441.

Referring to FIGS. 1 through 8, the auxiliary shell 5 includes a main part 51 and a pair of side walls 52, and a rear wall 53. The main part 51 has four bulges 511. The side wall 52 has a fixing leg 521. The rear wall 53 has a pair of fixing legs 531.

Figure 9:
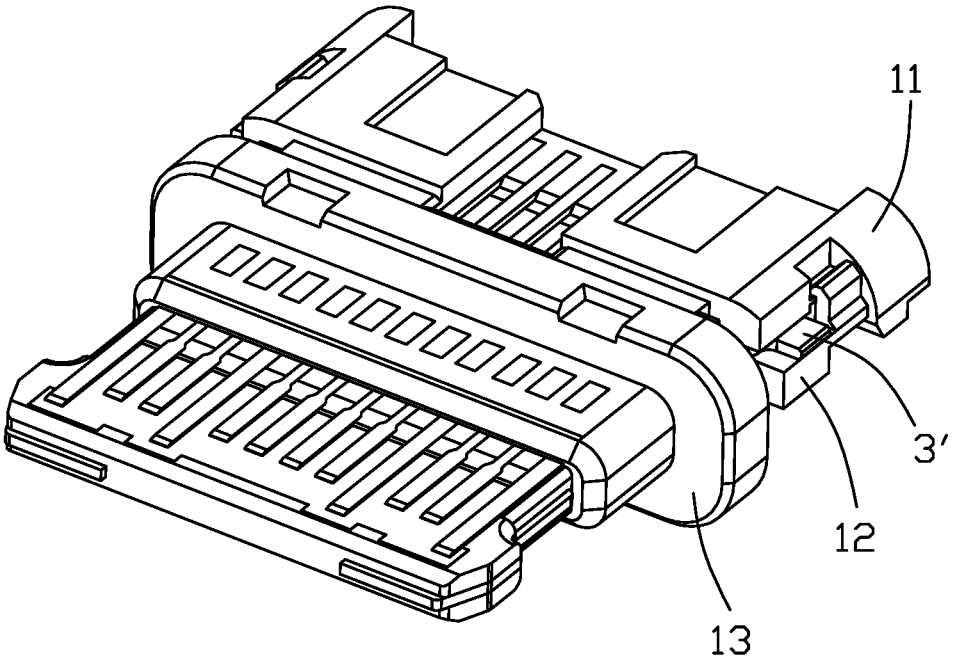
FIG. 9 is a perspective view of a terminal module in accordance with a second embodiment of the present invention.
Figure 10:
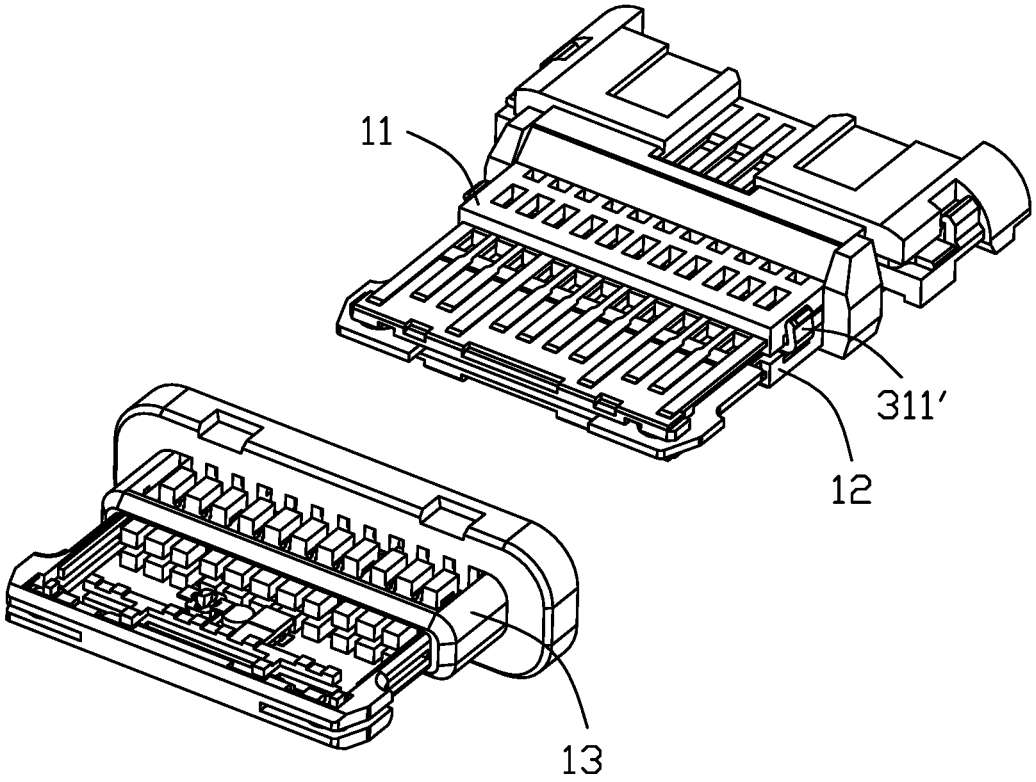
FIG. 10 is an exploded view of the terminal module in FIG. 9.
Figure 11:
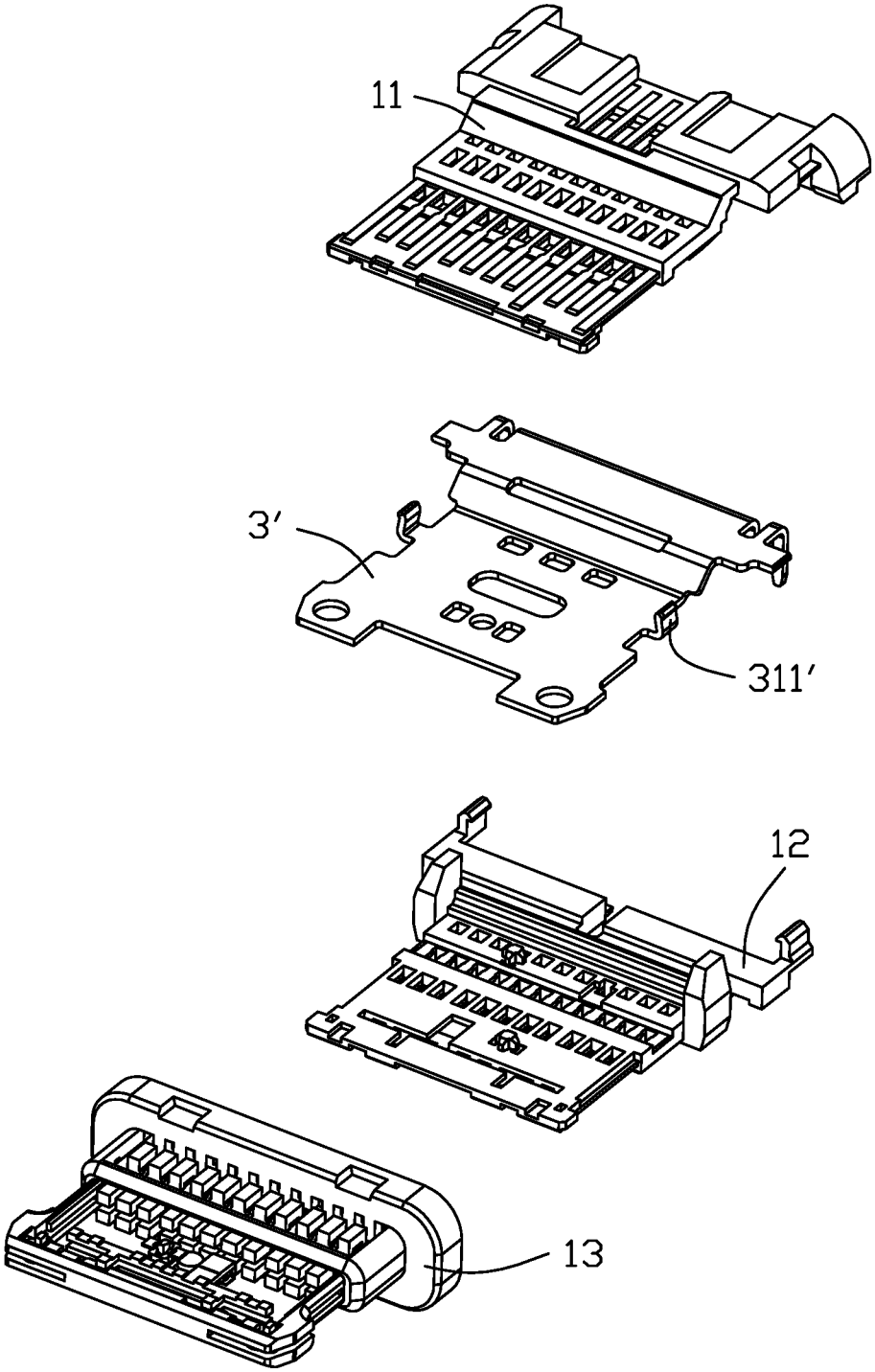
FIG. 11 is a further exploded view of the terminal module in FIG. 10.
Figure 12:
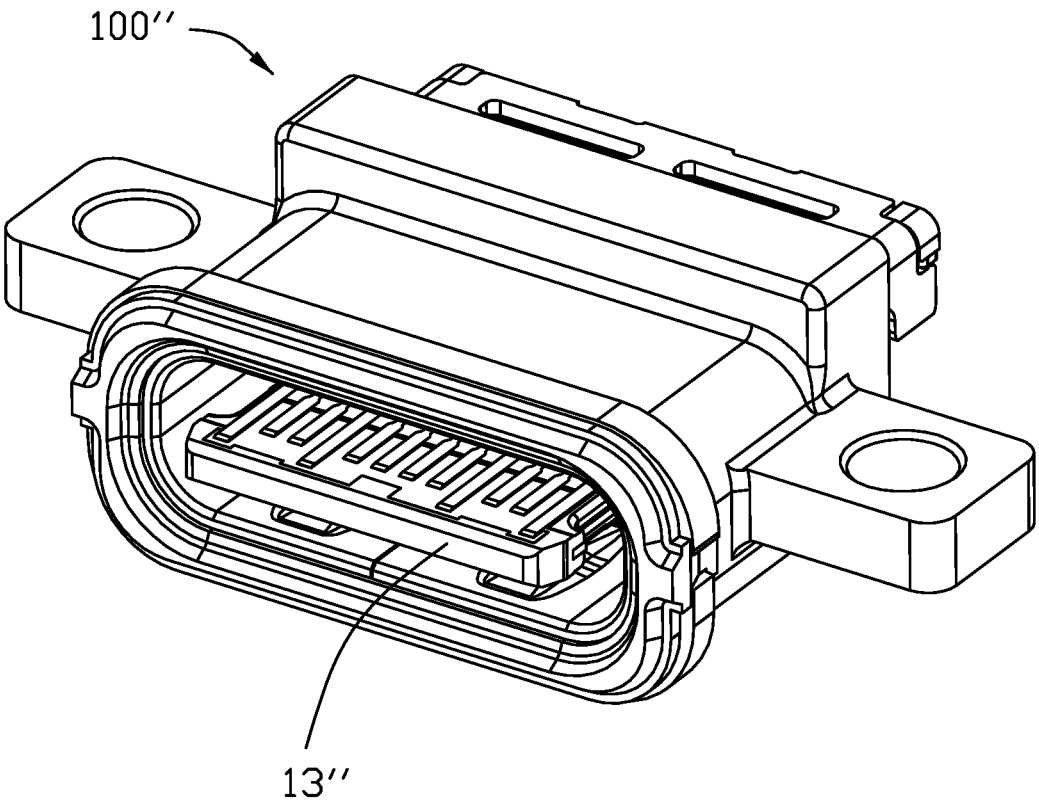
FIG. 12 is a perspective view of an electrical connector in accordance with a third embodiment of the present invention.
Figure 13:
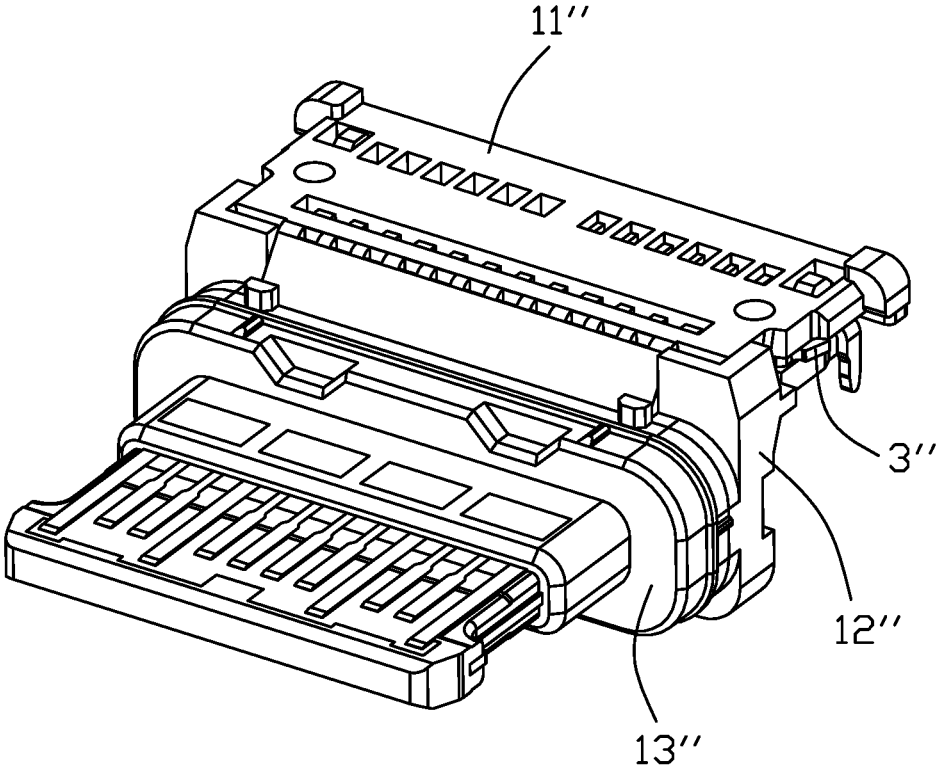
FIG. 13 is a perspective view of a terminal module of the electrical connector in FIG. 12.
Figure 14:
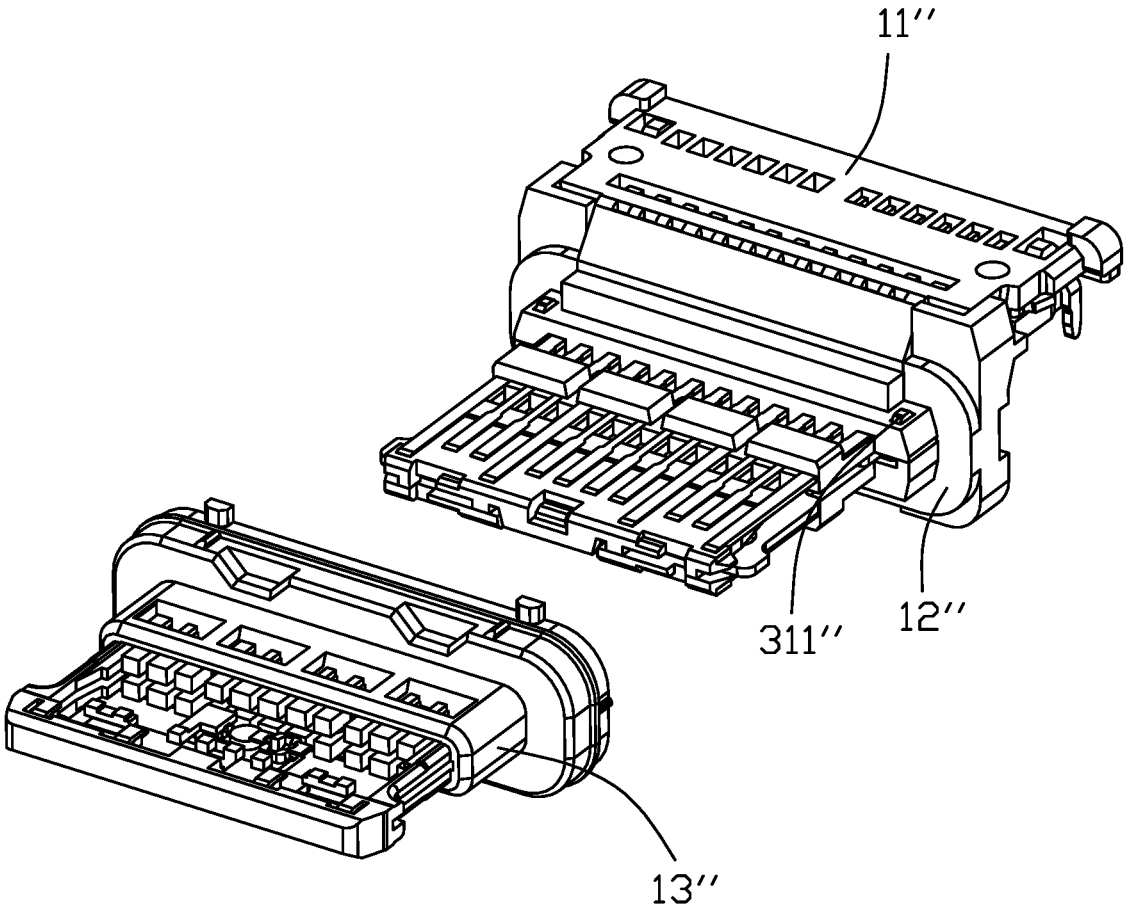
FIG. 14 is an exploded view of the terminal module in FIG. 13.
Figure 15:
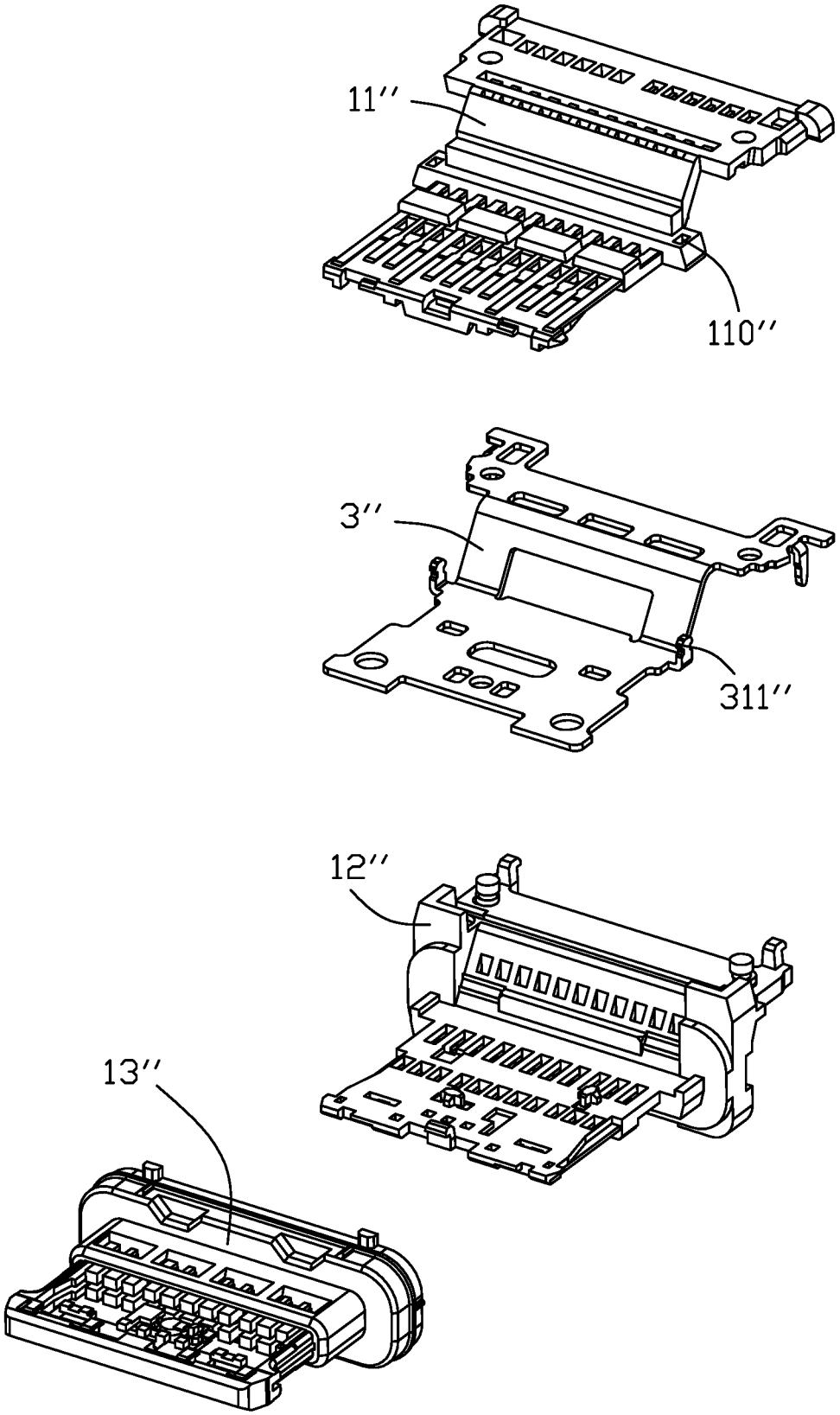
FIG. 15 is a further exploded view of the terminal module in FIG. 14.

FIGS. 9-11 show a terminal module of a second embodiment which is essentially same as the first embodiment except for the pair of flexible engaging arms 311' of the plate 3'. The engaging arm 311' flexibly abuts the insulator outer face by a wider face thereof rather than by a narrower edge portion. Again, after over-molding the insulator 13, the pair of engaging arms 311' are buried.

FIGS. 12-15 show a terminal module of a third embodiment which is essentially same as the first embodiment except for the pair of flexible engaging arms 311" of the plate 3". The upper insulator 11" has a pair of holes 110" at two opposite side portions thereof. The pair of engaging arms 311" are flexibly inserted into the pair of holes 110" of the two side portions, respectively. After over-molding the insulator 13, the pair of engaging arms 311" are also buried. Notably, in the first embodiment, each engaging arm extends in a vertical plane perpendicular to a front-to-back direction while in the other two embodiments, the engaging arm extends in a vertical plane perpendicular to the transverse direction wherein in the third embodiment, the engaging arm is further received within a hole of the upper insulator.

What is claimed is:

1. An electrical connector comprising:

a terminal module including an upper unit having a first row of contacts integrally formed within an upper insulator, a lower unit having a second row of contacts integrally formed within a lower insulator, and a shielding plate between the upper and lower units, each of the upper and lower units including a rear base and a front tongue, the rear base of the upper unit being locked to the rear base of the lower unit; and a shielding shell enclosing the terminal module; wherein the shielding plate has a pair of upwardly extending engaging arms to sandwich two opposite lateral sides of the upper insulator for temporarily retaining the upper unit to the shielding plate, and an over-molding insulator is applied upon the stacked upper unit and lower unit with the shielding plate therebetween to further cover and bury said pair of upwardly extending engaging arms; wherein each of the pair of engaging arms extends in a vertical plane perpendicular to a front-to-back direction; and wherein the shielding plate includes a main portion and a rear extension higher than the main portion in a vertical direction with an oblique junction linked therebetween, a pair of legs downwardly extending from the rear extension, and the pair of upwardly extending engaging arms are located in a rear area of the main portion.

2. An electrical connector comprising:

a terminal module including an upper unit having a first row of contacts integrally formed within an upper insulator, a lower unit having a second row of contacts integrally formed within a lower insulator, and a shielding plate between the upper and lower units, each of the upper and lower units including a rear base and a front tongue, the rear base of the upper unit being locked to the rear base of the lower unit; and a shielding shell enclosing the terminal module; wherein the shielding plate has a pair of upwardly extending engaging arms to sandwich two opposite lateral sides of the upper insulator for temporarily retaining the upper unit to the shielding plate, and an over-molding insulator is applied upon the stacked upper unit and lower unit with the shielding plate therebetween to further cover and bury said pair of upwardly extending engaging arms; wherein each of the pair of engaging arms extends in a vertical plane perpendicular to a transverse direction; and wherein the shielding plate includes a main portion and a rear extension higher than the main portion in a vertical direction with an oblique junction linked therebetween, a pair of legs downwardly extending from the rear extension, and the pair of upwardly extending engaging arms are located in a rear area of the main portion.

3. An electrical connector comprising:

a terminal module including an upper unit having a first row of contacts integrally formed within an upper insulator, a lower unit having a second row of contacts integrally formed within a lower insulator, and a shielding plate between the upper and lower units, each of the upper and lower units including a rear base and a front tongue, the rear base of the upper unit being locked to the rear base of the lower unit; and a shielding shell enclosing the terminal module; wherein the shielding plate has a pair of upwardly extending engaging arms to sandwich two opposite lateral sides of the upper insulator for temporarily retaining the upper unit to the shielding plate, and an over-molding insulator is applied upon the stacked upper unit and lower unit with the shielding plate therebetween to further cover and bury said pair of upwardly extending engaging arms; wherein the shielding plate includes a main portion and a rear extension higher than the main portion in a vertical direction with an oblique junction linked therebetween, a pair of legs downwardly extending from the rear extension, and the pair of upwardly extending engaging arms are located in a rear area of the main portion.

* * * * *